US010350916B2

(12) United States Patent
Tamura et al.

(10) Patent No.: US 10,350,916 B2
(45) Date of Patent: Jul. 16, 2019

(54) PRINTING APPARATUS

(71) Applicant: SEIKO EPSON CORPORATION, Tokyo (JP)

(72) Inventors: Yosaku Tamura, Nagano (JP); Akinobu Nakahata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/994,189

(22) Filed: May 31, 2018

(65) Prior Publication Data

US 2018/0272764 A1 Sep. 27, 2018

Related U.S. Application Data

(63) Continuation of application No. 15/446,111, filed on Mar. 1, 2017, now Pat. No. 10,011,131.

(30) Foreign Application Priority Data

Mar. 9, 2016 (JP) ..... 2016-045578

(51) Int. Cl.

| | |
|---|---|
| ***B41J 29/38*** | (2006.01) |
| ***B41J 13/26*** | (2006.01) |
| ***B41J 3/60*** | (2006.01) |
| ***B41J 13/00*** | (2006.01) |
| ***B41J 13/02*** | (2006.01) |
| ***B41J 13/28*** | (2006.01) |

(52) U.S. Cl.

CPC ..... *B41J 13/26* (2013.01); *B41J 3/60* (2013.01); *B41J 13/009* (2013.01); *B41J 13/025* (2013.01); *B41J 13/28* (2013.01)

(58) Field of Classification Search

None

See application file for complete search history.

(56) References Cited

U.S. PATENT DOCUMENTS

2010/0276863 A1* 11/2010 Yano ..... B65H 9/004 271/3.14

2012/0069111 A1* 3/2012 Kaneko ..... B41J 3/60 347/104

FOREIGN PATENT DOCUMENTS

JP 2014-038201 A 2/2014

* cited by examiner

*Primary Examiner* — Matthew Luu
*Assistant Examiner* — Tracey M McMillion

(57) ABSTRACT

A printing apparatus includes a print section, a supply path, a correction roller pair, an adjusting mechanism and a controller. The print section is configured to perform printing on a medium. The supply path is configured to supply the medium to the print section. The correction roller pair is configured to enable the medium transported on the supply path to strike the correction roller pair to correct skewing of the medium. The adjusting mechanism adjusts a nip load applied to the correction roller pair. The controller is configured to control the adjusting mechanism based on print job information. The correction roller pair includes a driving roller that has a plurality of convex portions disposed on a peripheral surface along a circumferential direction of the driving roller and a driven roller that is disposed to face the driving roller to be driven by the driving roller.

11 Claims, 9 Drawing Sheets

PRINTING APPARATUS

CROSS-REFERENCE TO RELATED APPLICATIONS

This application is a continuation application of U.S. patent application Ser. No. 15/446,111 filed on Mar. 1, 2017. This application claims priority to Japanese Patent Application No. 2016-045578 filed on Mar. 9, 2016. The entire disclosures of U.S. patent application Ser. No. 15/446,111 and Japanese Patent Application No. 2016-045578 are expressly incorporated herein by reference.

BACKGROUND

1. Technical Field

The present invention relates to a printing apparatus for performing printing on a medium.

2. Related Art

A color printer, which is an example printing apparatus, including a transfer unit (printing unit) for transferring a toner image onto a sheet of paper, which is an example medium, is known (see, for example, JP-A-2014-38201). Such a color printer includes a registration roller pair (correction roller pair) that enables the leading edge of a sheet of paper to strike the registration roller pair to correct skewing of the sheet and transports the sheet toward the transfer unit.

If the pressing force of the registration roller pair is too weak (the pinching load is small, i.e., the nip load applied to the registration roller pair is small), the sheet can pass through the registration roller pair and the skewing is not corrected. On the other hand, if the pressing force of the registration roller pair is too strong, when the trailing edge of the sheet passes through the registration roller pair, the sheet transport speed changes undesirably. To address the problem, in the color printer, the pressing force of the registration roller pair is reduced after skewing of the sheet has been corrected.

In such a color printer (laser printer), the pressing force of the registration roller pair is reduced after the leading edge of the sheet has passed through the registration roller pair and before the trailing edge of the sheet passes through the registration roller pair.

Compared with the laser printer, an ink jet printer needs be more carefully designed to prevent transfer of ink onto a transport path, especially, transfer of ink onto a registration roller pair. Accordingly, it is preferable that the pressing force of the registration roller pair be changed at an appropriate time in consideration of skew correction and transfer prevention.

SUMMARY

An advantage of some aspect of the invention is that there is provided a printing apparatus capable of adjusting contact between a registration roller pair and paper and thereby reducing print quality degradation.

A printing apparatus according to one embodiment includes a print section, a supply path, a correction roller pair, an adjusting mechanism and a controller. The print section is configured to perform printing on a medium. The supply path is configured to supply the medium to the print section. The correction roller pair is configured to enable the medium transported on the supply path to strike the correction roller pair to correct skewing of the medium. The adjusting mechanism adjusts a nip load applied to the correction roller pair. The controller is configured to control the adjusting mechanism based on print job information. The correction roller pair includes a driving roller that has a plurality of convex portions disposed on a peripheral surface along a circumferential direction of the driving roller and a driven roller that is disposed to face the driving roller to be driven by the driving roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the attached drawings. The printing apparatus according to the embodiment is a printer that performs printing (recording) by discharging an ink, which is an example liquid, onto a medium such as paper to print (record) characters, images, and the like.

Figure 1:
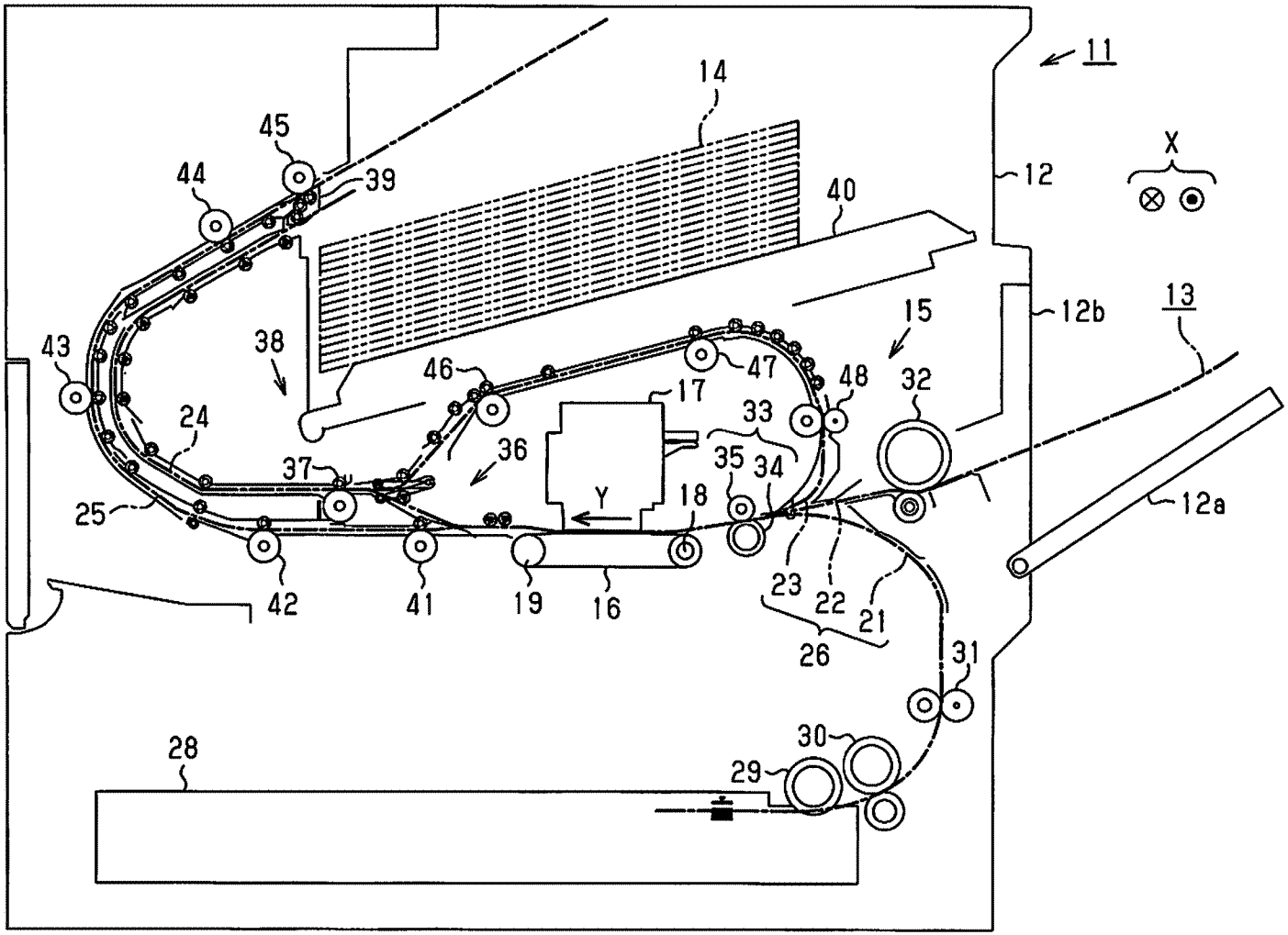
FIG. 1 is a schematic view of a printing apparatus according to an embodiment.

As illustrated in FIG. 1, a printing apparatus 11 according to the embodiment includes a substantially rectangular parallelepiped housing 12 and a transport section 15 that transports a medium 14 along a transport path 13 denoted by the alternate long and short dashed line in FIG. 1. The printing apparatus 11 further includes, along the transport path 13, a transport belt 16 that transports the medium 14 while supporting the medium 14 against gravity and a printing unit 17 that is disposed opposite the transport belt 16 with the transport path 13 therebetween.

The transport belt 16 is an endless belt and is looped around a drive pulley 18, which is driven by a drive source to rotate, and a driven pulley 19, which is freely rotatable around a shaft that is parallel to a shaft of the drive pulley 18. The transport belt 16 travels around the pulleys and transports the medium 14, which is supported by electrostatic adsorption on the outer peripheral surface of the transport belt 16. In other words, the outer peripheral surface of the transport belt 16 is a part of the transport path 13.

The printing unit 17 is a line head that can simultaneously discharge a liquid such as an ink in the width direction X of the medium 14. The width direction X intersects (for example, is orthogonal to) a transport direction Y in which the medium 14 is transported. The printing unit 17 performs printing onto the medium 14 by discharging a liquid onto the medium 14 that is transported by the transport belt 16.

The transport path 13 includes a first supply path 21, a second supply path 22, and a third supply path 23, which are on the upstream side of the transport belt 16 in the transport direction Y, and a branch path 24 and a discharge path 25, which are on the downstream side of the transport belt 16 in the transport direction Y. The first supply path 21, the second supply path 22, and the third supply path 23 serve as a supply path 26 along which the medium 14 is supplied toward the printing unit 17.

The first supply path 21 connects a medium cassette 28, which is detachably attached to a bottom section on the lower side in the direction of gravity, and the transport belt 16. In the first supply path 21, a pickup roller 29 for feeding the top medium 14 of the media 14 stacked in the medium cassette 28 and separation rollers 30 for separating the media 14 fed by the pickup roller 29 one by one, are provided. The first supply path 21 further includes a first supply roller pair 31 disposed on the downstream side of the separation rollers 30 in the transport direction Y.

The second supply path 22 connects an insertion slot 12*b*, which is exposed when a cover 12*a* provided on one side surface of the housing 12 is opened, and the transport belt 16. In the second supply path 22, a second supply roller pair 32 that pinches and transports the medium 14 that has been inserted from the insertion slot 12*b* is provided. At a position where the first supply path 21, the second supply path 22, and the third supply path 23 merge, a correction roller pair 33 is provided. The medium 14 transported on the supply path 26 strikes the correction roller pair 33, and thereby skewing of the medium 14 is corrected.

The correction roller pair 33 includes a driving roller 34 that is provided on the transport belt 16 side opposite the printing unit 17 with respect to the supply path 26 and a driven roller 35 that is provided on the printing unit 17 side with respect to the supply path 26. The driving roller 34 is rotated by a drive source such as a motor (not illustrated) in a counterclockwise direction. The correction roller pair 33 pinches the medium 14 by using the driving roller 34 and the driven roller 35, which is driven by the driving roller 34, and correction roller pair 33 rotates to transport the medium 14 toward the printing unit 17.

The third supply path 23 is disposed above the printing unit 17 to partially encompass the printing unit 17. The third supply path 23 returns again the medium 14 that has passed through the transport belt 16 and the printing unit 17 to the upstream side of the transport belt 16. On the downstream side of the transport belt 16, a branching mechanism 36 that is capable of guiding the medium 14 to the branch path 24 is provided. The branching mechanism 36 includes, for example, a flap. The branching mechanism 36 guides the medium 14, which has been guided toward the branch path 24, to the third supply path 23. In the branch path 24, a branch roller pair 37 that is rotatable in both forward and reverse directions is provided. In this embodiment, the branch path 24, the branching mechanism 36, and the branch roller pair 37 serve as a switchback mechanism 38. That is, the switchback mechanism 38 switches back the medium 14, which has a front side 14*a* that is an example first side and a back side 14*b* that is an example second side of the medium 14, on which printing has been performed on the front side 14*a*, to transport the medium 14 to the third supply path 23 (see FIG. 12).

The discharge path 25 connects a discharge port 39, from which the printed medium 14 is discharged, and the transport belt 16. The medium 14 discharged from the discharge port 39 is placed onto a mounting table 40. In the discharge path 25, at least one transport roller pair is provided. In this embodiment, five transport roller pairs, that is, a first transport roller pair 41 to a fifth transport roller pair 45, are provided. In the third supply path 23, at least one transport roller pair is provided. In this embodiment, three transport roller pairs, that is, a sixth transport roller pair 46 to an eighth transport roller pair 48, are provided.

The transport section 15 according to the embodiment includes the transport belt 16, the drive pulley 18, the driven pulley 19, the pickup roller 29, the first supply roller pair 31, the second supply roller pair 32, the correction roller pair 33, and the first transport roller pair 41 to the eighth transport roller pair 48.

Figure 2:
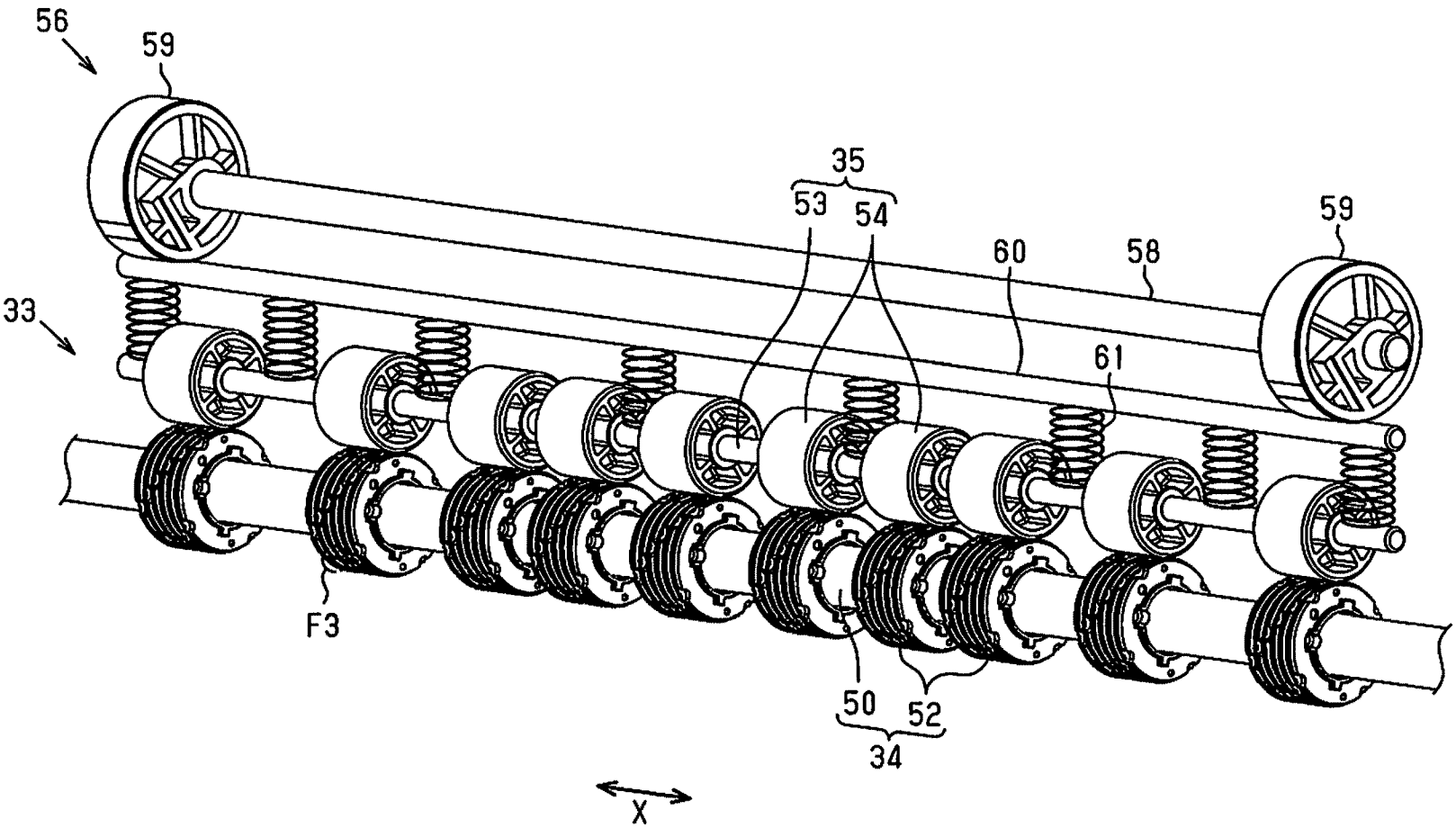
FIG. 2 is a perspective view of a correction roller pair and a switching mechanism.
Figure 3:
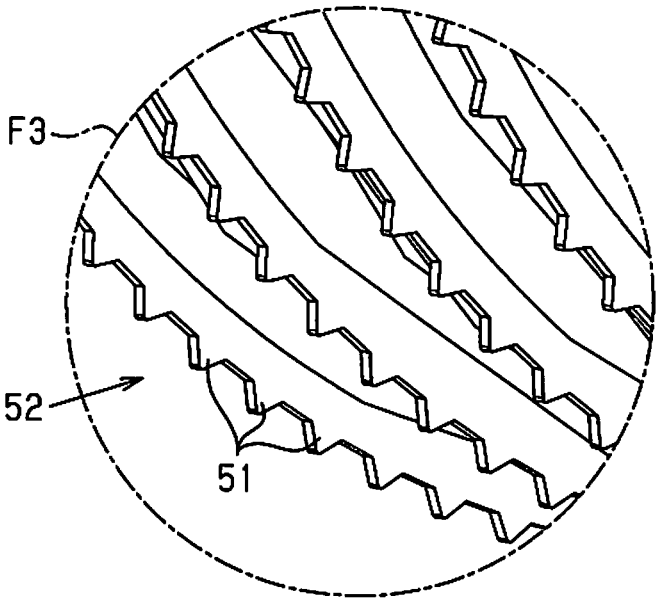
FIG. 3 is an enlarged view of a portion F3 in FIG. 2.

As illustrated in FIG. 2 and FIG. 3, the driving roller 34 of the correction roller pair 33 includes a drive shaft 50 that extends in the width direction X and at least one (in this embodiment, ten) toothed roller 52 having a plurality of convex portions (see FIG. 3) 51 on its peripheral surface. The drive shaft 50 is inserted into the toothed roller 52, and the toothed roller 52 is fixed to the drive shaft 50. The toothed roller 52 rotates together with the drive shaft 50. The toothed roller 52 includes a plurality of ring-shaped members (in this embodiment, six) each having a plurality of convex portions 51, and the ring-shaped member are combined together. Viewed in the X direction, each toothed roller 52 includes the six ring-shaped members that are combined together such that the alignment of the convex portions 51 of the ring-shaped members is shifted with respect to each other. This structure enables the respective convex portions 51 of the ring-shaped members of the toothed roller 52 to be arranged at different positions. Accordingly, the spaces between the adjacent convex portions 51 in a single ring-shaped member can be substantially reduced. This structure enables the leading edge of a medium to strike the correction roller pair 33, and thereby skewing of the medium can be appropriately corrected. If the spaces between the adjacent convex portions 51 are wide, relative spaces between the convex portions 51 corresponding to a portion of the leading edge of the skewed medium that first strikes the correction roller pair 33 and a portion of the leading edge that subsequently strikes the correction roller pair 33 are also wide. In such a case, due to the shape of the convex portions 51, the respective portions are caught on the convex portions 51 in the state where the space between the portion that strikes first the correction roller pair 33 and the portion that subsequently strikes the correction roller pair 33 is wide. As a result, skew correction is not sufficiently performed.

The driven roller 35 includes a driven shaft 53 that extends in the width direction X and at least one (the number of the cylindrical rollers 54 is the same as the number of the toothed rollers 52) cylindrical roller 54 that has no projections and depressions on its peripheral surface. The driven shaft 53 is movable in a direction (for example, the vertical direction) which intersects the width direction X and the transport direction Y. The cylindrical roller 54 is rotatably supported by the driven shaft 53 and disposed to face the toothed roller 52 in the width direction X.

The printing apparatus 11 includes a switching mechanism 56 that switches pinching loads applied to the correction roller pair 33 to pinch the medium 14. The switching mechanism 56 includes a round-bar shaped driver section 58 that is rotated by the driving force of a switching motor 57 (see FIG. 4) and at least one (in this embodiment, two) cam section 59 that rotates together with the driver section 58. The switching mechanism 56 further includes a round-bar shaped driven section 60 that adjoins the cam section 59 and at least one (in this embodiment, eight) biasing member 61 that is provided between the driven section 60 and the driven shaft 53 such as a coil spring. The pinching load applied to the correction roller pair 33 to pinch the medium 14 corresponds to a nip load applied to the correction roller pair 33. Accordingly, the term "pinching load" in this specification can be read as "nip load".

The cam section 59 has a substantially disc shape and is an eccentric cam into which the driver section 58 is inserted at a position different from the center. The driven section 60 extends in the width direction X and is movable in a direction (for example, the vertical direction) that intersects the width direction X and the transport direction Y similarly to the driven shaft 53.

Figure 4:
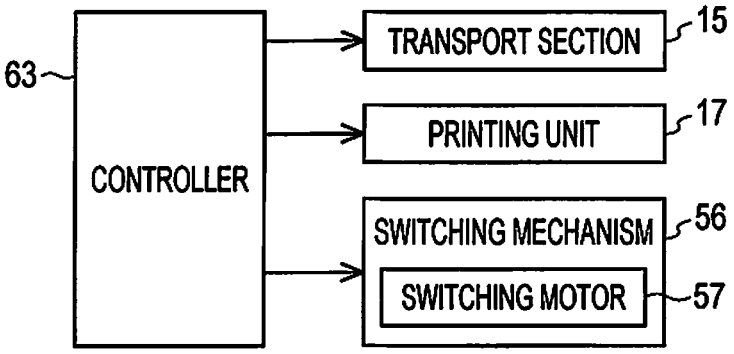
FIG. 4 is a block diagram of a controller.

Now, an electrical configuration of the printing apparatus 11 will be described. As illustrated in FIG. 4, the printing apparatus 11 includes a controller 63 that controls the switching mechanism 56 based on print job information input from an external device (not illustrated) or the like. The controller 63 performs overall drive control of the mechanisms such as the transport section 15, the printing unit 17, and other mechanisms in the printing apparatus 11. The print job information according to the embodiment includes which one of one-sided printing and two-sided printing is to be performed, the size of the margin, the number of sheets, the type of the medium 14, the grammage, and the like.

Hereinafter, a load switching process routine to be performed by the controller 63 will be described with reference to the flowchart in FIG. 5. The load switching process routine is executed when a print job is started by a user.

Figure 5:
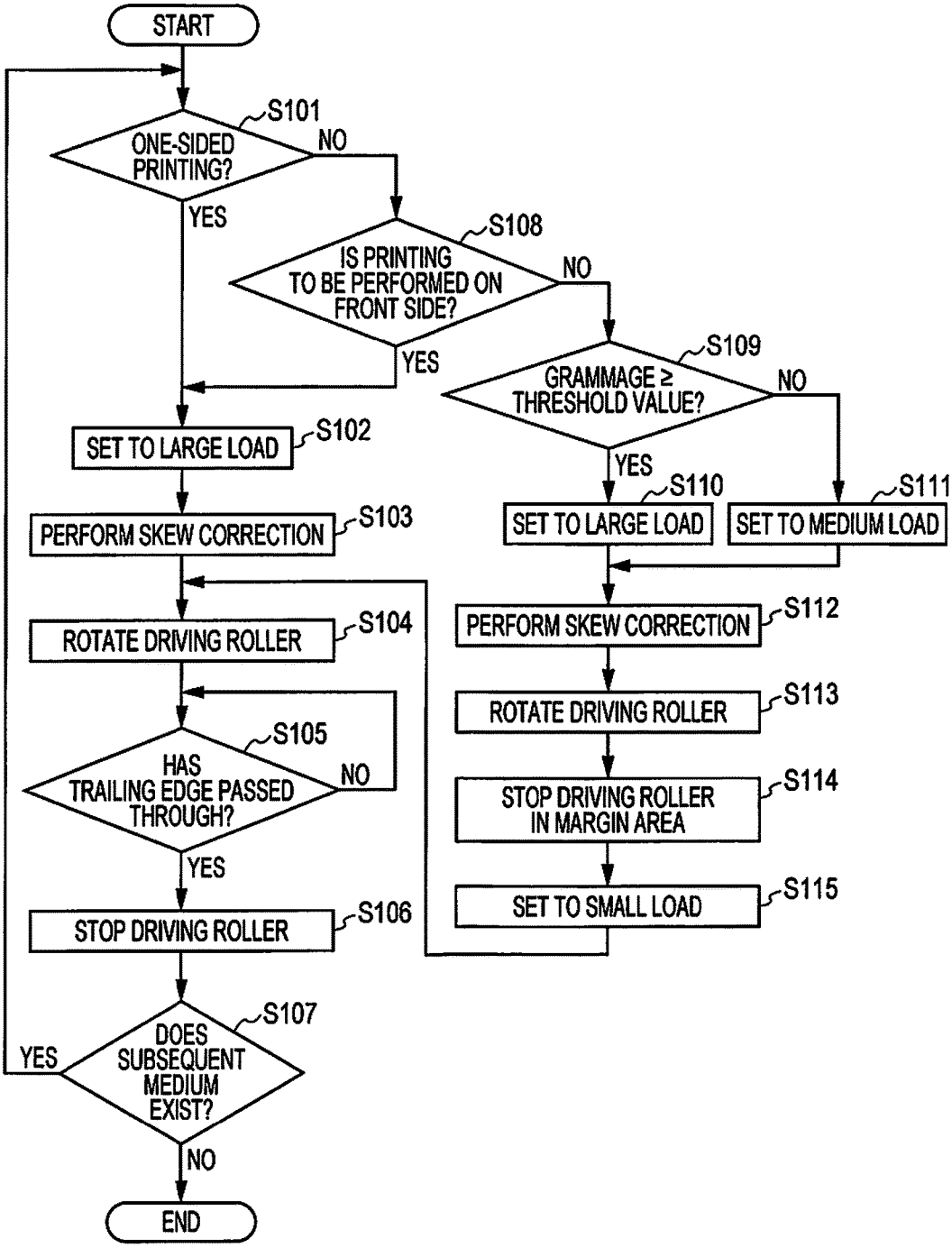
FIG. 5 is a flowchart of a load switching processing routine.

As illustrated in FIG. 5, in step S101, the controller 63 determines based on print job information which one of one-sided printing and two-sided printing is to be performed. If one-sided printing is to be performed (YES in step S101), in step S102, the controller 63 causes the switching mechanism 56 to set a pinching load to be applied when the correction roller pair 33 pinches the medium 14 to a large load.

In step S103, the controller 63 performs skew correction for correcting skewing of the medium 14 by enabling the medium 14 to strike the stationary driving roller 34 at a leading edge of the medium 14. In step S104, the controller 63 causes the driving roller 34 to rotate.

In step S105, the controller 63 determines whether the trailing edge of the medium 14 has passed through the correction roller pair 33. If the trailing edge of the medium 14 has not passed through the correction roller pair 33 (NO in step S105), the controller 63 enables the driving roller 34 to keep rotating and stand by until the medium 14 passes through the correction roller pair 33. If the trailing edge of the medium 14 has passed through the correction roller pair 33 (YES in step S105), in step S106, the controller 63 causes the driving roller 34 to stop.

In step S107, the controller 63 determines based on the print job information whether a subsequent medium 14 to pass through the correction roller pair 33 exists. If no subsequent medium 14 exists (NO in step S107), the controller 63 ends the process. If a subsequent medium 14 exists (YES in step S107), the process goes to step S101.

In step S101, if two-sided printing is to be performed (NO in step S101), in step S108, the controller 63 determines whether printing is to be performed on the front side 14*a* or the back side 14*b*. In this embodiment, a side to be printed first is defined as the front side 14*a* and a side to be printed after the printing of the front side 14*a* has been performed is defined as the back side 14*b*. If the front side printing is to be performed (YES in step S108), the controller 63 moves the process to step S102. If the back side printing is to be performed (NO in step S108), in step S109, the controller 63 determines based on the print job information whether the grammage of the medium 14 is greater than or equal to a threshold value (for example, 90 g/m$^2$).

If the grammage of the medium 14 is greater than or equal to the threshold value (YES in step S109), in step S110, the controller 63 sets the pinching load to the large load. If the grammage of the medium 14 is smaller than the threshold value (NO in step S109), in step S111, the controller 63 sets the pinching load to a medium load. The medium load is smaller than the large load.

In step S112, the controller 63 performs skew correction to the medium 14 similarly to step S103. In step S113, the controller 63 causes the driving roller 34 to rotate, and in step S114, the controller 63 causes the driving roller 34 to stop while the correction roller pair 33 is pinching a margin area B (see FIG. 13) of the medium 14. In step S115, the controller 63 sets the pinching load to the small load. The small load is smaller than the large load and the middle load. Then, the controller 63 moves the process to step S104.

Now, operations of the printing apparatus 11 for performing printing onto the medium 14 will be described. First, an operation to be performed when print job information for performing one-sided printing on two (two sheets of) media 14 supplied from the medium cassette 28 is described.

Figure 6:
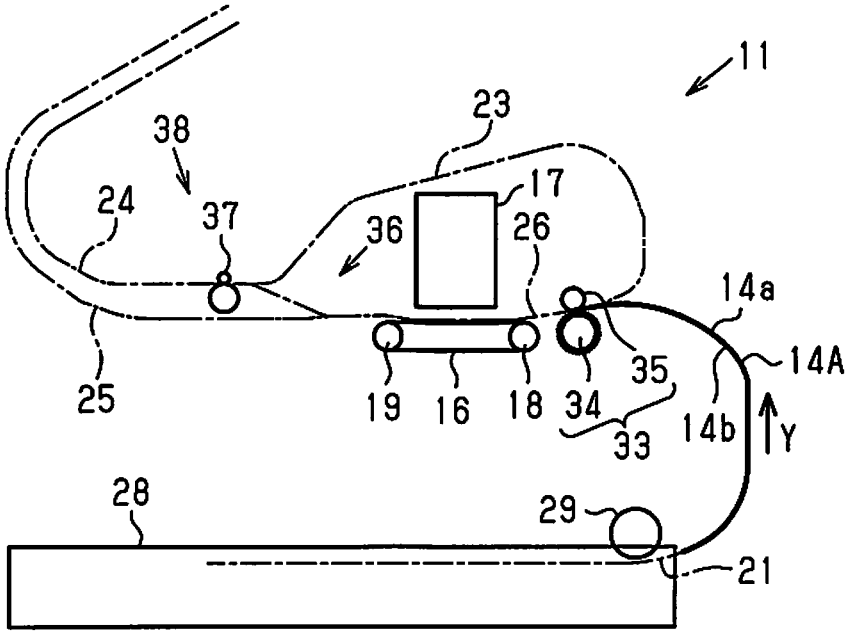
FIG. 6 is a schematic view of a printing apparatus during a first transport operation of a first medium.

As illustrated in FIG. 6, the controller 63 causes the pickup roller 29 to drive to feed a first medium 14A, which is the first sheet, from the medium cassette 28. Then, the first medium 14A is transported on the first supply path 21 with the front side 14*a* being placed on the printing unit 17 side, and the leading edge strikes the stationary correction roller pair 33.

Figure 7:
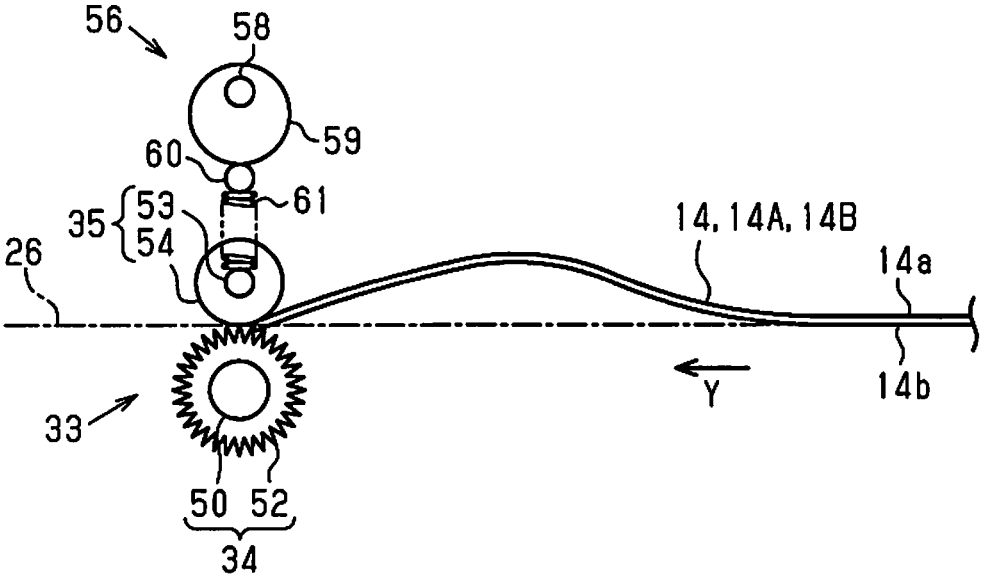
FIG. 7 is a schematic view of a correction roller pair that performs skew correction under a large lord.

As illustrated in FIG. 7, the controller 63 sets the pinching load to be applied to the correction roller pair 33 to the large load before the leading edge of the first medium 14A reaches the correction roller pair 33. That is, the controller 63 causes the switching motor 57 to drive to rotate the cam section 59 such that the length from the rotation center of the cam section 59 to its peripheral surface becomes long. When the leading edge of the first medium 14A strikes the correction roller pair 33, the first medium 14A bends and skewing of the first medium 14A is corrected (hereinafter, may also be referred to as "skew correction").

Figure 8:
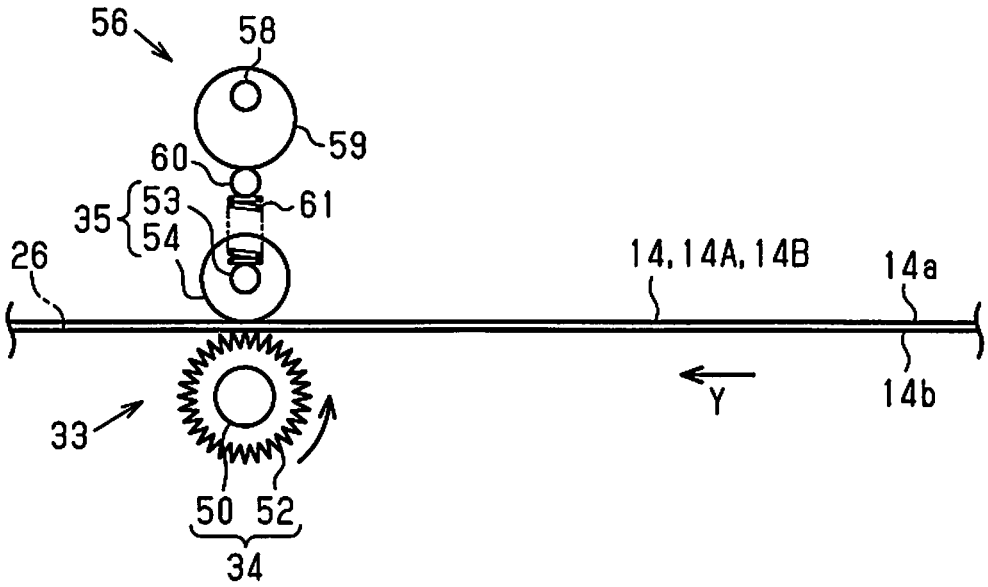
FIG. 8 is a schematic view of a correction roller pair that transports a first medium under a large lord.

As illustrated in FIG. 8, after skewing of the first medium 14A has been corrected, the controller 63 causes the driving roller 34 to rotate while maintaining the pinching load at the large load to transport the first medium 14A toward the printing unit 17. The printing unit 17 discharges a liquid such as an ink to perform printing onto the front side 14*a* of the first medium 14A when the first medium 14A passes through the printing unit 17.

Figure 9:
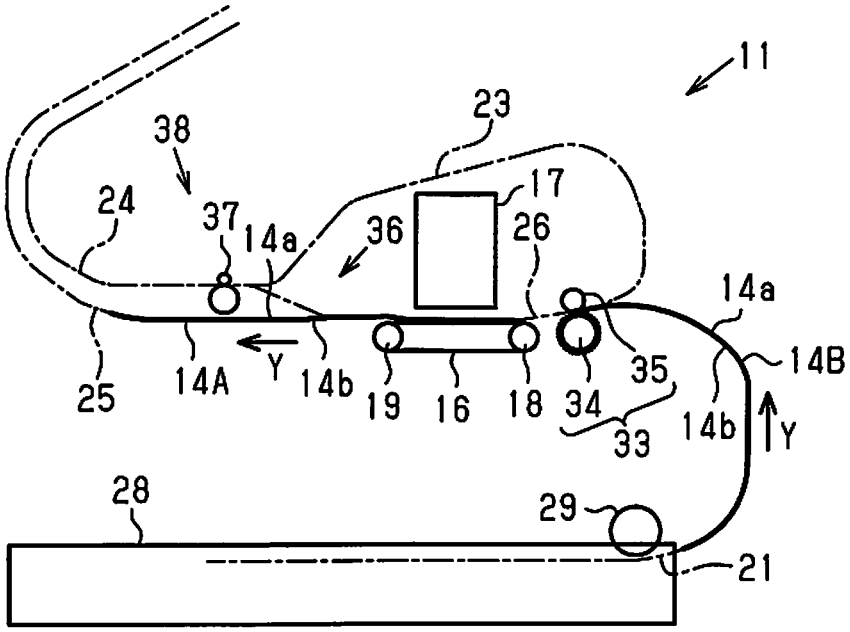
FIG. 9 is a schematic view of a printing apparatus that performs one-sided printing on a first medium and a second medium.

As illustrated in FIG. 9, the printed first medium 14A is transported on the discharge path 25. The controller 63 causes the pickup roller 29 to drive to feed a second medium 14B, which is the second sheet, subsequently to the first medium 14A from the medium cassette 28. The second medium 14B is transported on the first supply path 21 with the front side 14*a* being placed on the printing unit 17 side, and the leading edge strikes the stationary correction roller pair 33, which is maintaining the large load, and skew correction is performed similarly to the first medium 14A accordingly (see FIG. 7). After skew correction has been performed, the second medium 14B is transported by the correction roller pair 33, which is maintaining the large load, toward the printing unit 17 (see FIG. 8). That is, when the printing is performed only on one side (the front side 14*a*) of the medium 14, the pinching load is maintained at the large load.

Next, an operation to be performed in response to an input of print job information for two-sided printing on two (two sheets of) media 14 supplied from the medium cassette 28 is described. The first medium 14A, which is the first sheet, is thick paper having a grammage of a threshold value or greater, and the second medium 14B, which is the second sheet, is thin paper having a grammage smaller than the threshold value. The operation for performing printing onto the front side 14*a* of the first medium 14A, which is the first sheet, is similar to that in the one-sided printing, and its description is omitted.

Figure 10:
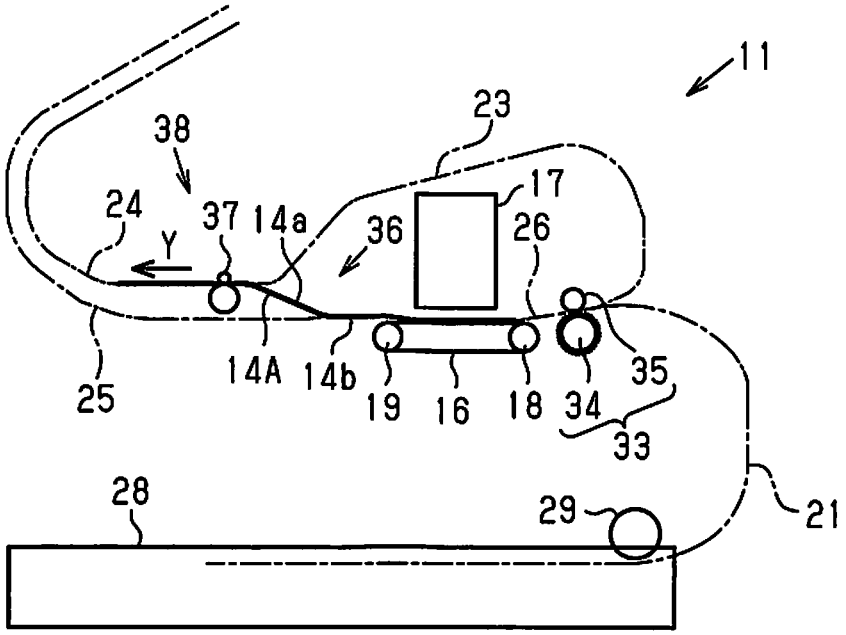
FIG. 10 is a schematic view of a printing apparatus that guides a first medium, on which printing has been performed, to a branch path.

As illustrated in FIG. 10, the first medium 14A, on which printing has been performed on the front side 14*a* by the printing unit 17, is guided to the branch path 24 by the branching mechanism 36. In the first transport operation with the front side 14*a* of the medium 14A being located on the printing unit 17 side, the pinching load being applied to the correction roller pair 33 is maintained at the large load during skew correction and pinching and transporting of the first medium 14A.

The next medium 14 that passes through the correction roller pair 33 is the second medium 14B whose front side 14*a* is located on the printing unit 17 side. Consequently, after the trailing edge of the first medium 14A has passed through the correction roller pair 33, the pinching load applied to the correction roller pair 33 is maintained at the large load suitable for the first transport operation of the second medium 14B.

Figure 11:
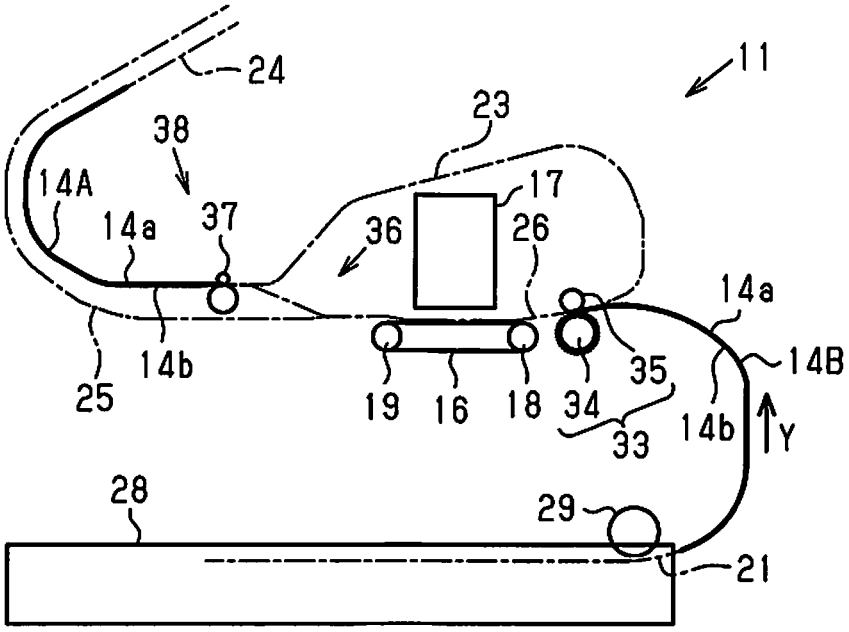
FIG. 11 is a schematic view of a printing apparatus that performs skew correction on a second medium.

As illustrated in FIG. 11, the controller 63 causes the pickup roller 29 to drive to feed the second medium 14B, which is the second sheet, subsequently to the first medium 14A from the medium cassette 28. The second medium 14B is transported on the first supply path 21, and the leading edge strikes the correction roller pair 33, which is maintaining the large load, and skew correction is performed accordingly similarly to the first medium 14A (see FIG. 7).

In other words, during the first transport operation with the front side 14*a* being located on the printing unit 17 side, the printing apparatus 11 performs skew correction by using the correction roller pair 33 under the large load regardless of the grammage of the medium 14. Then, the controller 63 causes the driving roller 34 to rotate after skew correction to transport the second medium 14B toward the printing unit 17 while maintaining the large load (see FIG. 8).

Figure 12:
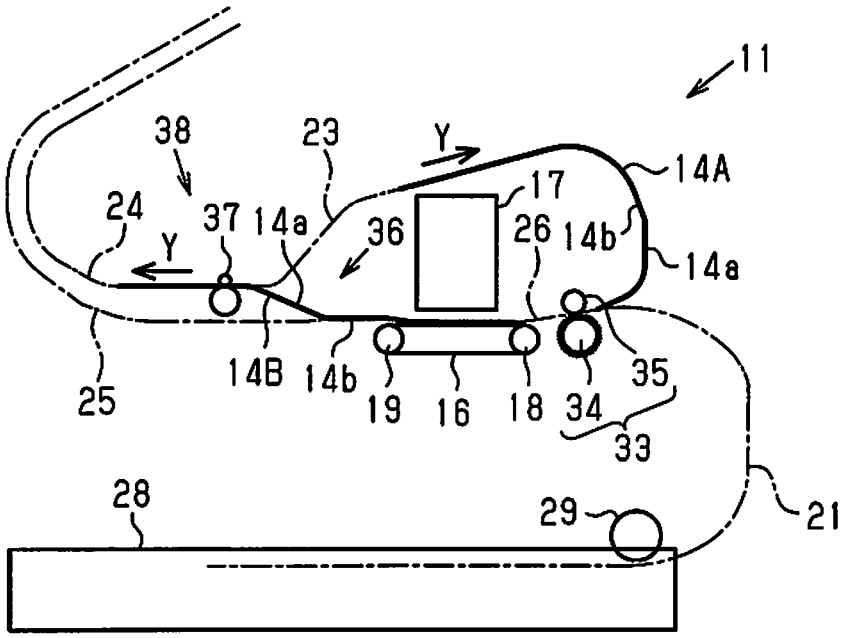
FIG. 12 is a schematic view of the printing apparatus that performs a second transport operation of a first medium and a first transport operation of a second medium.

As illustrated in FIG. 12, the branch roller pair 37 is reversely driven to reversely transport the first medium 14A, which has been held on the branch path 24, on the branch path 24, and the first medium 14A is further guided by the branching mechanism 36 to the third supply path 23. The second medium 14B, on which printing has been performed on the front side 14*a*, is guided to the branch path 24 by the branching mechanism 36. Consequently, the next medium 14 that passes through the correction roller pair 33 is the first medium 14A whose back side 14*b* is located on the printing unit 17 side. After the trailing edge of the second medium 14B has passed through the correction roller pair 33, the pinching load of the correction roller pair 33 is maintained at the large load, which is suitable for the second transport operation of the first medium 14A.

In other words, during the second transport in which the first medium 14A is switched back by the switchback mechanism 38 and the back side 14*b* is located on the printing unit 17 side, the leading edge strikes the stationary correction roller pair 33 that is maintaining the large load, and skew correction is performed accordingly. After the skew correction has been performed, the controller 63 causes the driving roller 34 to rotate to transport the first medium 14A toward the printing unit 17.

Figure 13:
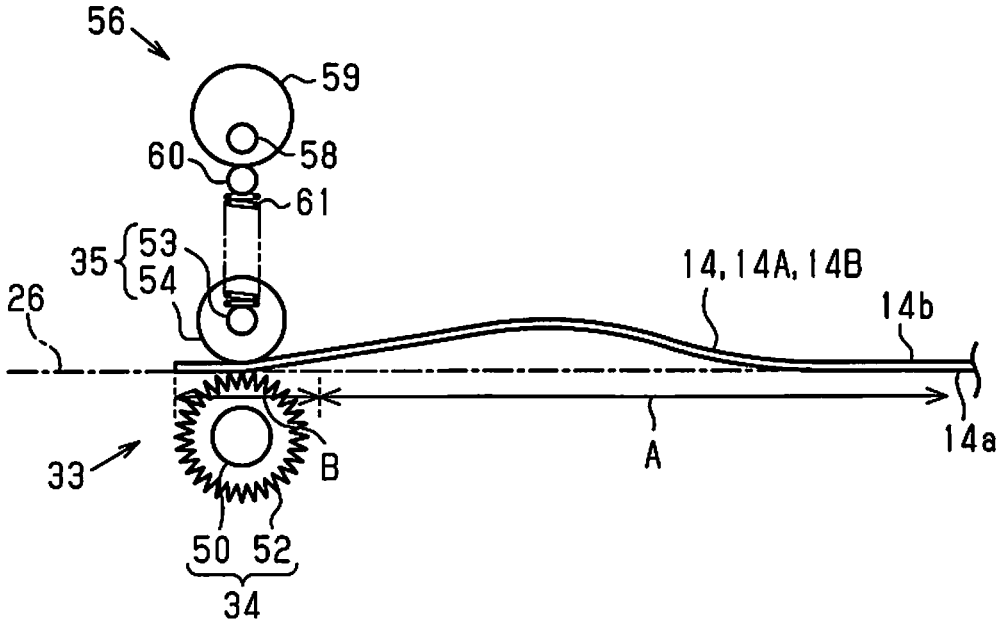
FIG. 13 is a schematic view of the correction roller pair, in which the load being applied to the correction roller pair is changed to a small load in a margin area.

As illustrated in FIG. 13, the controller 63 stops the rotation of the driving roller 34 while the correction roller pair 33 is pinching the margin area B. Then, the controller 63 causes the switching motor 57 to drive to rotate the cam section 59 by 180 degrees such that the length from the rotation center of the cam section 59 to its peripheral surface becomes short to switch the pinching load applied to the correction roller pair 33 to the small load. That is, during the second transport operation of the first medium 14A, the controller 63 reduces the pinching load while the correction roller pair 33 is pinching the margin area B, which is from the leading edge of the first medium 14A to a print area A on the front side 14*a*.

In other words, in the first transport operation and the second transport operation, the pinching load in the second transport operation is reduced compared with the pinching load in the first transport. During the second transport, the controller 63 reduces the pinching load before the correction roller pair 33 pinches the print area A on the front side 14*a*. Then, the controller 63 causes the driving roller 34, which is maintaining the small load, to rotate to transport the first medium 14A toward the printing unit 17. Then, the printing unit 17 performs printing on the back side 14*b* of the first medium 14A.

Figure 14:
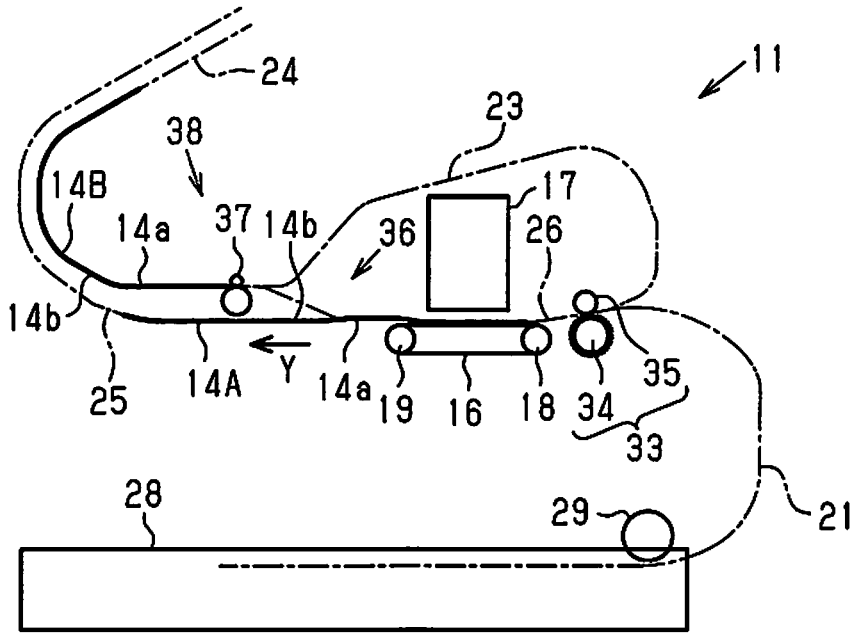
FIG. 14 is a schematic view of a printing apparatus that performs printing on the back side of a first medium.

As illustrated in FIG. 14, the first medium 14A, on which printing has been performed on both front side 14*a* and back side 14*b*, is transported on the discharge path 25. After the trailing edge of the first medium 14A has passed through the correction roller pair 33 in the second transport, the controller 63 changes the pinching load in accordance with the type of the medium 14 to next be printed. That is, the next medium 14 that passes through the correction roller pair 33 is the second medium 14B whose back side 14*b* is located on the printing unit 17 side. Consequently, the pinching load applied to the correction roller pair 33 is switched to the medium load, which is suitable for the second transport operation of the second medium 14B having the grammage smaller than the threshold value.

Figure 15:
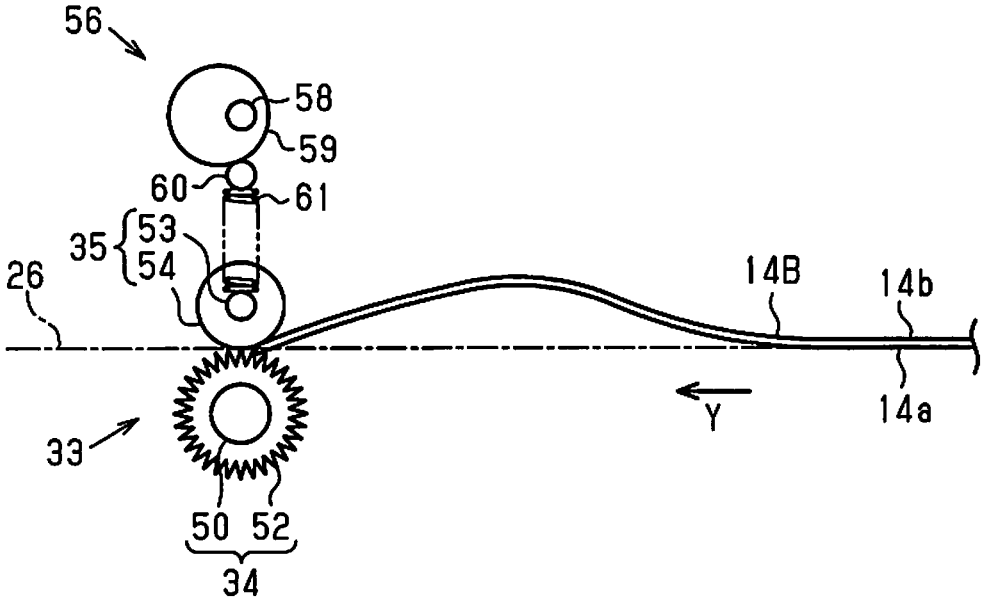
FIG. 15 is a schematic view of a correction roller pair that performs skew correction under a medium lord.

Specifically, as illustrated in FIG. 15, the controller 63 causes the driving roller 34 to stop, and drives the switching motor 57 to rotate the cam section 59 by 90 degrees to switch the pinching load applied to the correction roller pair 33 from the small load to the middle load. That is, when the grammage of the medium 14 is smaller than the threshold value, the controller 63 reduces the pinching load to the pinching load smaller than the large load, which is suitable for the first transport, before the correction roller pair 33 pinches the medium 14 in the second transport. Then, the second medium 14B is switched back by the switchback mechanism 38 and transported on the third supply path 23, and the leading edge of the second medium 14B strikes the correction roller pair 33 and skew correction is performed accordingly.

After the skew correction, the controller 63 causes the driving roller 34 to rotate to transport the second medium 14B toward the printing unit 17, and reduces the pinching load in the margin area B of the second medium 14B similarly to the second transport operation of the first medium 14A.

That is, as illustrated in FIG. 13, during the second transport operation of the second medium 14B, the controller 63 reduces the pinching load while the correction roller pair 33 is pinching the margin area B, which is from the leading edge of the second medium 14B to the print area A on the front side 14*a*. Specifically, the controller 63 stops the drive of the driving roller 34 while the correction roller pair 33 is pinching the margin area B, and switches the pinching load applied to the correction roller pair 33 from the middle load to the small load. To switch the pinching load from the middle load to the small load, the controller 63 causes the cam to rotate by 90 degrees. Consequently, compared with the case where the cam section is rotated by 180 degrees to switch the pinching load applied to the correction roller pair 33 from the large load to the small load, the pinching load can be switched to the small load in a short time. Then, the controller 63 transports the second medium 14B toward the printing unit 17. On the back side 14*b* of the second medium 14B, printing is performed and the second medium 14B is discharged.

According to the above-described embodiment, the following advantages can be achieved.

(1) The controller 63 controls the switching mechanism 56 based on print job information such that the pinching load applied to the correction roller pair 33 to pinch the medium 14 can be switched. That is, for example, the pinching load can be switched based on the type of the medium 14, the size of the margin, or the like included in the print job information, and print quality degradation can be reduced accordingly.

(2) After printing has been performed on the front side 14*a* in the first transport, the medium 14 is switched back by the switchback mechanism 38 and printing is performed on the back side 14*b* in the second transport. As a result, when the second transport operation is performed, printing has already been performed on the front side 14*a*. Consequently, the controller 63 reduces the pinching load in the second transport operation compared with the pinching load in the first transport operation, and this small pinching load can prevent print quality degradation on the previously printed front side 14*a*.

(3) The controller 63 reduces the pinching load before the correction roller pair 33 pinches the print area A on the front side 14*a*, and accordingly, the print area A on the front side 14*a* is pinched under the small pinching load. Consequently, when printing is performed on the front side 14*a* and the back side 14*b*, this small pinching load can reduce print quality degradation on the previously printed front side 14*a*.

(4) For example, reducing the pinching load when the leading edge of the medium 14 is striking the correction roller pair 33 may enable the medium 14 to pass through the correction roller pair 33 and this may cause skewing. To address the problem, in this structure, the controller 63 reduces the pinching load while the correction roller pair 33 is pinching the medium 14, and this small pinching load can reduce the occurrence of the skewing of the medium 14.

(5) The smaller the grammage is, the lower the firmness of the medium 14 is. Accordingly, when the medium 14 having a small grammage strikes the correction roller pair 33 to which the reduced pinching load has been applied, the medium 14 cannot easily pass through the correction roller pair 33. Consequently, when the grammage of the medium 14 is smaller than the threshold value, the pinching load can be reduced before the correction roller pair 33 pinches the medium 14. By this operation, the time necessary to switch the pinching loads can be reduced.

(6) After the trailing edge of the medium 14 has passed through the correction roller pair 33, the pinching load is changed in accordance with the type of the medium 14 to next be printed. This change can prevent the medium 14 to next be printed from passing through the correction roller pair 33 when the medium 14 strikes the correction roller pair 33.

The above-described embodiment may be modified as described below.

In the above-described embodiment, the controller 63 may change the pinching load while the driving roller 34 is being driven.

In the above-described embodiment, the printing apparatus 11 may feed a next medium 14 after printing has been made on the front side 14*a* and the back side 14*b* of the medium 14. For example, after the printing apparatus 11 has performed printing on the front side 14*a* and the back side 14*b* of the first medium 14A, the printing apparatus 11 may perform printing on the second medium 14B.

In the above-described embodiment, the switching mechanism 56 may be an electromagnetic clutch that can press the driven roller 35. Furthermore, for example, the switching mechanism 56 may include a plurality of electromagnetic clutches, and the number of the electromagnetic clutches for pressing the driven roller 35 may be changed to change the magnitude of the pinching load.

In the above-described embodiment, after the feeding of the medium 14, the controller 63 may change the pinching load applied to the correction roller pair 33 in accordance with the type of the fed medium 14.

In the above-described embodiment, after the print area A of the medium 14 has passed through the correction roller pair 33, the controller 63 may change the pinching load applied to the correction roller pair 33 in accordance with the type of the medium 14 to next be printed.

In the above-described embodiment, the controller 63 may control the switching mechanism 56 regardless of the grammage of the medium 14.

In the above-described embodiment, when the medium 14 having a grammage smaller than the threshold value is transported in the second transport, the controller 63 may perform skew correction under the medium load and transport the medium 14 while maintaining the middle load. That is, the medium 14 may be transported under the middle load, which is smaller than the large load.

In the above-described embodiment, the levels of the switchable pinching loads may be two. For example, the pinching load may be switched between the large load and the small load. When the grammage of the medium 14 is smaller than the threshold value, the pinching load may be switched to the small load before the correction roller pair 33 pinches the medium 14 in the second transport. That is, the skew correction may be performed under the small load. Furthermore, the levels of the switchable pinching loads may be four or more. For example, the pinching load adjustment may be stepless adjustment. In such a case, the pinching load may be adjusted in accordance with the rotational angle of the cam section 59.

In the above-described embodiment, in the second transport operation of the medium 14, the controller 63 may reduce the pinching load after the skew correction has been made and before the driving roller 34 is driven. That is, the pinching load may be reduced while the correction roller pair 33 is not pinching the medium 14. Furthermore, the controller 63 may control the switching mechanism 56 based on the print job information about whether the margin area B exists or not. That is, for example, if the margin area B exists, the controller 63 may reduce the pinching load while the correction roller pair 33 is pinching the margin area B, whereas if the margin area B does not exist, the controller 63 may reduce the pinching load before the correction roller pair 33 pinches the medium 14. Furthermore, for example, if the grammage is greater than or equal to the threshold value, the controller 63 may reduce the pinching load while the correction roller pair 33 is pinching the margin area B, whereas if the grammage is smaller than the threshold, the controller 63 may reduce the pinching load before the correction roller pair 33 pinches the medium 14.

In the above-described embodiment, the controller 63 may control the switching mechanism 56 in accordance with a print duty (an amount of liquid to be applied per unit area) that is included in print job information. For example, the higher the print duty is, the more an image scraped by the correction roller pair 33 is retransferred and adheres to a subsequent medium 14. On the other hand, the lower the print duty is, the less the image is retransferred. Consequently, for example, when the print duty is low, in the second transport operation of the medium 14, the correction roller pair 33 may pinch the print area A on the front side 14*a*, and then the controller 63 may reduce the pinching load. If the pinching load being applied to the correction roller pair 33 is changed during printing, the print color may change before and after the pinching load change, and this change may cause image quality degradation. To address the problem, to change the pinching load in the print area A, it is preferable that the pinching load be changed before the printing unit 17 starts printing.

In the above-described embodiment, the printing apparatus 11 may omit the switchback mechanism 38. Furthermore, the printing apparatus 11 may include at least one of the first supply path 21 to the third supply path 23. The printing apparatus 11 that omits the switchback mechanism 38 and the third supply path 23 may perform printing on the front side 14*a* of the medium 14 and feed the medium 14 again to perform printing on both sides. That is, the controller 63 may control the switching mechanism 56 depending on whether printing has been performed on the front side 14*a* of the medium 14, which is transported based on the print job information. Specifically, to transport the medium 14 on which printing has not been performed on the front side 14*a*, the printing apparatus 11 may increase the pinching load. On the other hand, to transport the medium 14 on which printing has been performed on the front side 14*a* and then to perform printing on the back side 14*b*, the pinching load may be reduced.

In the above-described embodiment, the printing apparatus 11 may be a fluid ejection apparatus that ejects or discharges a fluid (for example, a liquid, a liquid material containing particles of a functional material dispersed or mixed in a liquid, a fluid material such as a gel, and a solid that can be ejected as a fluid) other than inks for recording. For example, the printing apparatus 11 may be a liquid material ejecting apparatus that ejects a liquid material containing a dispersed or dissolved material such as an electrode material or a color material (pixel material) used for manufacturing liquid crystal displays, electroluminescence (EL) displays, or field emission displays (FEDs) for recording. The printing apparatus 11 may be a fluid material ejecting apparatus that ejects a fluid material such as a gel (for example, a physical gel), or a powder and granular material ejecting apparatus (for example, a toner jet type recording apparatus) that ejects a solid, for example a powder (powder and granular material) such as a toner. The present invention can be applied to any one of the fluid ejecting apparatuses. In this specification, "fluid" implies a concept that does not include fluids that consist of only gas, and the fluid includes, for example, liquids (including inorganic solvents, organic solvents, solutions, liquid resins, liquid metals (metallic melts), and the like), liquid materials, fluid materials, and powder and granular materials (including grains and powders).

As explained above, a printing apparatus related to one embodiment includes a print section configured to perform printing on a medium, a supply path configured to supply the medium to the print section, a correction roller pair configured to enable the medium transported on the supply path to strike the correction roller pair to correct skewing of the medium, an adjusting mechanism for adjusting a nip load applied to the correction roller pair, and a controller configured to control the adjusting mechanism based on print job information.

With this structure, the controller controls the adjusting mechanism based on print job information to adjust the nip load applied to the correction roller pair. That is, for example, the nip load can be adjusted based on the type of medium, the size of a margin of the medium, or the like included in the print job information, and print quality degradation can be reduced accordingly.

The printing apparatus may further include a switchback mechanism for switching back the medium having a first side and a second side on which printing has been performed on the first side and for transporting the medium to the supply path. In the printing apparatus, between a first transport operation in which the first side is on the print section side and a second transport operation in which the medium is switched back by the switchback mechanism and the second side is on the print section side, the controller reduces the nip load in the second transport operation compared to the nip load in the first transport.

With this structure, after printing has been performed on the first side in the first transport, the medium is switched back by the switchback mechanism and printing is performed on the second side in the second transport. As a result, when the second transport operation is performed, printing has already been performed on the first side. The controller reduces the nip load in the second transport operation compared with the nip load in the first transport, and this small nip load enables a reduction in print quality degradation on the previously printed first side.

In this printing apparatus, the controller may reduce the nip load in the second transport operation before the correction roller pair pinches the print area on the first side. With this structure, the controller reduces the nip load before the correction roller pair pinches the print area on the first side, and accordingly, the print area on the first side is pinched under the small nip load. Consequently, when printing is performed on both the first side and the second side, this small nip load enables a reduction in print quality degradation on the previously printed first side.

In this printing apparatus, when the grammage of the medium is smaller than a threshold value, before the correction roller pair pinches the medium in the second transport, the controller may switch the nip load to a second nip load that is smaller than the nip load in the first transport.

The smaller the grammage of the medium, the lower the firmness of the medium. Accordingly, when a medium having a small grammage strikes the correction roller pair to which the small nip load has been applied, the medium cannot easily pass through the correction roller pair. Consequently, when the grammage of the medium is smaller than the threshold value, the nip load can be reduced in advance before the correction roller pair pinches the medium. By this operation, the time necessary to adjust the nip loads can be reduced.

In the printing apparatus, the controller may switch the nip load to a third nip load, which is smaller than the second nip load, in the second transport operation while the correction roller pair is pinching a margin area, which extends from a leading edge of the medium to a print area on the first side.

For example, reducing the nip load when the leading edge of the medium is striking the correction roller pair may enable the medium to pass through the correction roller pair and this may cause skewing. To address this problem, in this structure, the controller reduces the nip load while the correction roller pair is pinching the medium, and this small nip load can reduce the occurrence of the medium skewing.

In the printing apparatus, the controller may adjust the nip load in accordance with the type of medium to next be printed after a trailing edge of the medium has passed through the correction roller pair in the second transport.

With this structure, after the trailing edge of the medium has passed through the correction roller pair, the nip load is changed in accordance with the type of medium to next be printed. This change can prevent the medium to next be printed from passing through the correction roller pair when the medium strikes the correction roller pair.

In this printing apparatus, the correction roller pair may include a driving roller that includes at least one toothed roller and a driven roller that is driven by the driving roller, and that when the print section performs printing onto the one side of the medium, the driven roller come into contact with one side of the medium and the driving roller come into contact with the other side of the medium to pinch and transport the medium.

With this structure, after printing has been performed on the first side of the medium and printing is to next be performed on the second side of the medium, the printed first side of the medium comes into contact with the toothed roller and the medium is transported when printing is performed on the second side of the medium. Consequently, this structure can reduce transfer of an image (for example, ink) printed on the first side of the medium onto the driving roller because the contact area of the driving roller with the first side of the medium is small when the toothed roller comes into contact with the first side of the medium compared with the case where the flat surface comes into contact with the first side of the medium. Furthermore, the nip load applied to the correction roller pair is reduced in advance before the correction roller pair nips the print area on the first side of the medium. This small nip load further reduces transfer of the image printed on the first side of the medium onto the driving roller.

What is claimed is:

1. A printing apparatus comprising:

a print section configured to perform printing on a medium;

a supply path configured to supply the medium to the print section;

a correction roller pair configured to enable the medium transported on the supply path to strike the correction roller pair to correct skewing of the medium;

an adjusting mechanism for adjusting a nip load applied to the correction roller pair; and a controller configured to control the adjusting mechanism based on print job information, wherein the correction roller pair includes a driving roller that has a plurality of convex portions disposed on a peripheral surface along a circumferential direction of the driving roller and a driven roller that is disposed to face the driving roller to be driven by the driving roller, and when viewed from a width direction that intersects a transport direction in which the medium is transported, the plurality of convex portions disposed on the peripheral surface along the circumferential direction of the driving roller are shifted from each other so that each of the plurality of convex portions is not overlapped in the circumferential direction of the driving roller.

2. The printing apparatus according to claim 1, wherein, the driving roller includes a plurality of toothed rollers having a plurality of teeth, and a phase of each of the plurality of teeth in the plurality of toothed rollers is shifted from each other in the circumferential direction of the driving roller.

3. The printing apparatus according to claim 1, further comprising:

a switchback mechanism for switching back the medium having a first side and a second side, of which printing has been performed on the first side, and for transporting the medium to the supply path, wherein, between a first transport operation in which the first side is on the print section side and a second transport operation in which the medium is switched back by the switchback mechanism and the second side is on the print section side, the controller reduces a nip load in the second transport operation compared to a nip load in the first transport operation.

4. The printing apparatus according to claim 3, wherein the driving roller comes into contact with the first side of the medium, on which printing has been performed, in the second transport operation.

5. The printing apparatus according to claim 3, wherein, when a grammage of the medium is smaller than a threshold value, before the correction roller pair pinches the medium in the second transport operation, the controller switches the nip load to a second nip load that is smaller than the nip load in the first transport operation.

6. The printing apparatus according to claim 5, wherein the controller switches the nip load to a third nip load that is smaller than the second nip load in the second transport operation while the correction roller pair is pinching a margin area that extends from a leading edge of the medium to a print area on the first side.

7. The printing apparatus according to claim 3, wherein the controller adjusts the nip load in accordance with a type of medium to next be printed after a trailing edge of the medium has passed through the correction roller pair in the second transport operation.

8. The printing apparatus according to claim 3, wherein the correction roller pair includes a driving roller that includes at least one toothed roller and a driven roller that is driven by the driving roller, and the driven roller comes into contact with one side of the medium and the driving roller comes into contact with the other side of the medium to pinch and transport the medium when the print section performs printing onto the one side of the medium.

9. The printing apparatus according to claim 1, wherein the driving roller includes a toothed roller that includes a plurality of ring-shaped members having a plurality of teeth on a peripheral surface along a circumferential direction of the ring-shaped members, and a phase of each of the plurality of teeth of adjacent ring-shaped members is shifted from each other in the circumferential direction of the driving roller.

10. A printing apparatus comprising:

a print section configured to perform printing on a medium;

a supply path configured to supply the medium to the print section;

a correction roller pair configured to enable the medium transported on the supply path to strike the correction roller pair to correct skewing of the medium;

an adjusting mechanism for adjusting a nip load applied to the correction roller pair; and a controller configured to control the adjusting mechanism based on print job information, wherein the correction roller pair includes a driving roller that has a plurality of convex portions disposed on a peripheral surface along a circumferential direction of the driving roller and a driven roller that is disposed to face the driving roller to be driven by the driving roller, the driving roller includes a plurality of toothed rollers having a plurality of teeth, and a phase of each of the plurality of teeth in the plurality of toothed rollers is shifted from each other in the circumferential direction of the driving roller.

11. A printing apparatus comprising:

a print section configured to perform printing on a medium;

a supply path configured to supply the medium to the print section;

a correction roller pair configured to enable the medium transported on the supply path to strike the correction roller pair to correct skewing of the medium;

an adjusting mechanism for adjusting a nip load applied to the correction roller pair; and a controller configured to control the adjusting mechanism based on print job information, wherein the correction roller pair includes a driving roller that has a plurality of convex portions disposed on a peripheral surface along a circumferential direction of the driving roller and a driven roller that is disposed to face the driving roller to be driven by the driving roller, the driving roller includes a toothed roller that includes a plurality of ring-shaped members having a plurality of teeth on a peripheral surface along a circumferential direction of the ring-shaped members, and a phase of each of the plurality of teeth of adjacent ring-shaped members is shifted from each other in the circumferential direction of the driving roller.

* * * * *